US007925189B2

(12) United States Patent
Norigoe

(10) Patent No.: US 7,925,189 B2
(45) Date of Patent: Apr. 12, 2011

(54) ROTATOR FOR POWDER CONVEYANCE AND TONER CARTRIDGE

(75) Inventor: Masatoshi Norigoe, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 477 days.

(21) Appl. No.: 12/048,249

(22) Filed: Mar. 14, 2008

(65) Prior Publication Data

US 2008/0240789 A1 Oct. 2, 2008

(30) Foreign Application Priority Data

Mar. 28, 2007 (JP) ..... 2007-084136

(51) Int. Cl.
*G03G 15/08* (2006.01)

(52) U.S. Cl. ..... 399/256; 399/254; 366/320

(58) Field of Classification Search ..... 399/256
See application file for complete search history.

(56) References Cited

U.S. PATENT DOCUMENTS

| | | | | |
|---|---|---|---|---|
| 4,610,068 | A | 9/1986 | Schultz | |
| 4,634,286 | A | 1/1987 | Pike | |
| 4,887,132 | A | 12/1989 | Joseph et al. | |
| 4,956,675 | A | 9/1990 | Joseph | |
| 5,146,277 | A | 9/1992 | Fox et al. | |
| 6,585,406 | B2 | 7/2003 | Toepper et al. | |
| 7,137,730 | B2 * | 11/2006 | Eck et al. | 366/320 |
| 2005/0123321 | A1 * | 6/2005 | Buhay-Kettelkamp et al. | 399/254 |

FOREIGN PATENT DOCUMENTS

JP 2004-085812 A 3/2004

* cited by examiner

*Primary Examiner* — David M Gray
*Assistant Examiner* — Roy Yi
(74) *Attorney, Agent, or Firm* — Sughrue Mion, PLLC

(57) ABSTRACT

A rotator for powder conveyance includes a substantially linear rotary supporting shaft and plural stirring/conveying pieces. The plural stirring/conveying pieces are separated from each other and arranged in a longitudinal direction along the rotary supporting shaft, are placed at positions separated from a central axis of the rotary supporting shaft in a radial direction of the rotary supporting shaft, have a spiral configuration along an outer peripheral surface of the rotary supporting shaft, and are respectively connected to the rotary supporting shaft via a connecting piece at plural points.

22 Claims, 7 Drawing Sheets

ROTATOR FOR POWDER CONVEYANCE AND TONER CARTRIDGE

CROSS-REFERENCE TO RELATED APPLICATIONS

This application is based on and claims priority under 35 USC 119 from Japanese Patent Application No. 2007-084136 filed on Mar. 28, 2007.

BACKGROUND

1. Technical Field

The present invention relates to a toner cartridge that is used in an image forming apparatus such as an electrophotographic copier, printer, or facsimile machine, or a complex machine, and to a rotator for powder conveyance that is used for stirring and conveyance of powder such as toner.

2. Related Art

An image forming apparatus such as an electrophotographic copier or printer has a toner cartridge for supplying toner used in printing an image.

SUMMARY

A first aspect of the present invention provides a rotator for powder conveyance including: a substantially linear rotary supporting shaft; and plural stirring/conveying pieces that: are separated from each other and arranged in a longitudinal direction along the rotary supporting shaft; are placed at positions separated from a central axis of the rotary supporting shaft in a radial direction of the rotary supporting shaft; have a spiral configuration along an outer peripheral surface of the rotary supporting shaft; and are respectively connected to the rotary supporting shaft via a connecting piece at plural points.

BRIEF DESCRIPTION OF THE DRAWINGS

Exemplary embodiments of the present invention will now be described in detail with reference to the following figures, wherein.

DETAILED DESCRIPTION

First Exemplary Embodiment

A first exemplary embodiment of a rotator for powder conveyance and a toner cartridge using the rotator according to the present invention will be described with reference to FIGS. 2-5. It should be noted that a rotator for powder conveyance and a toner cartridge using the rotator according to the present invention is not limited to the exemplary embodiment described below.

Figure 1:
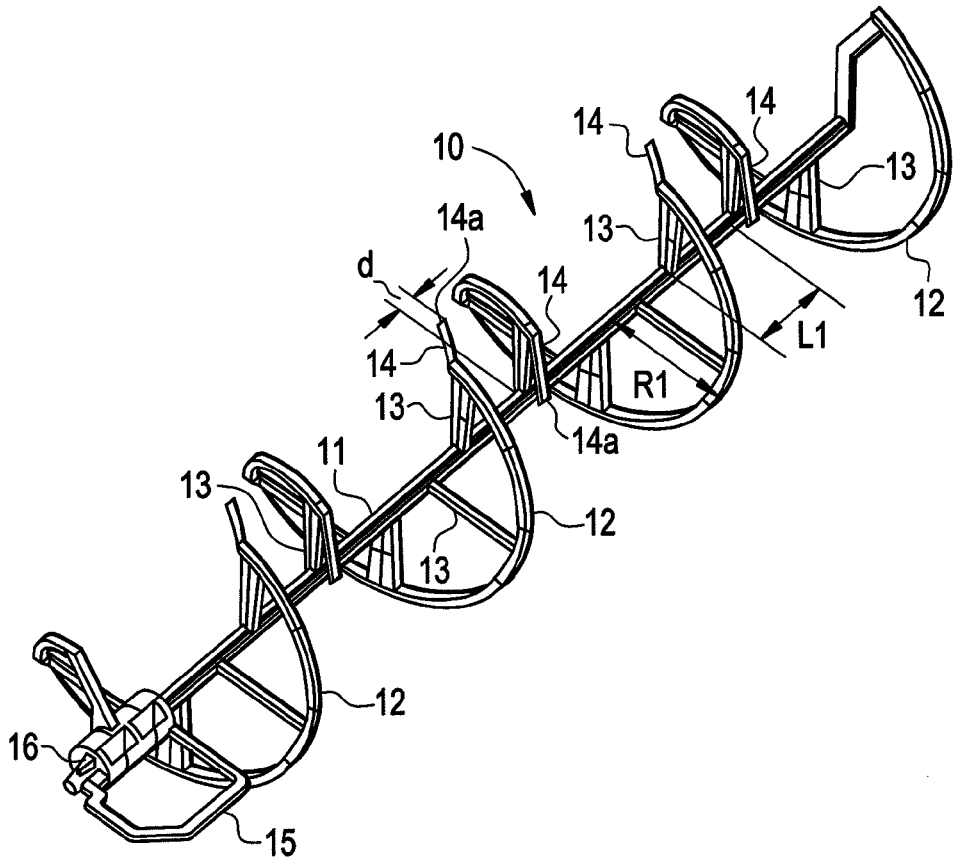
FIG. 1 is an external view of a rotator for powder conveyance according to a first exemplary embodiment of the present invention.
Figure 2:
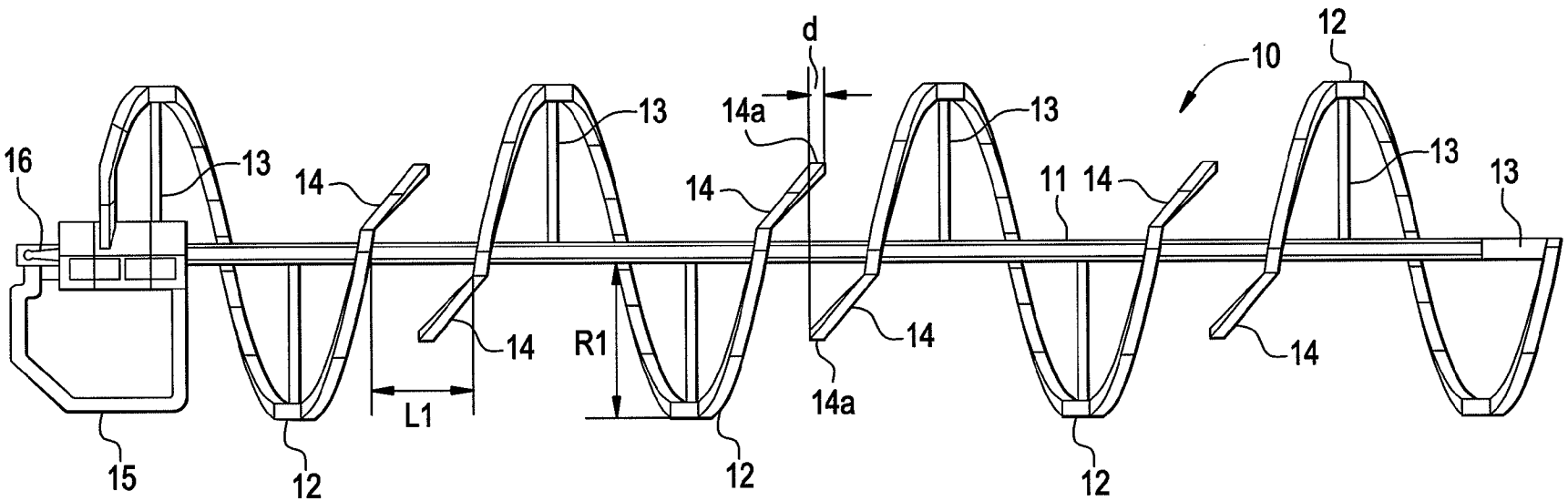
FIG. 2 is a plain view of a rotator for powder conveyance according to a first exemplary embodiment of the present invention.
Figure 3:
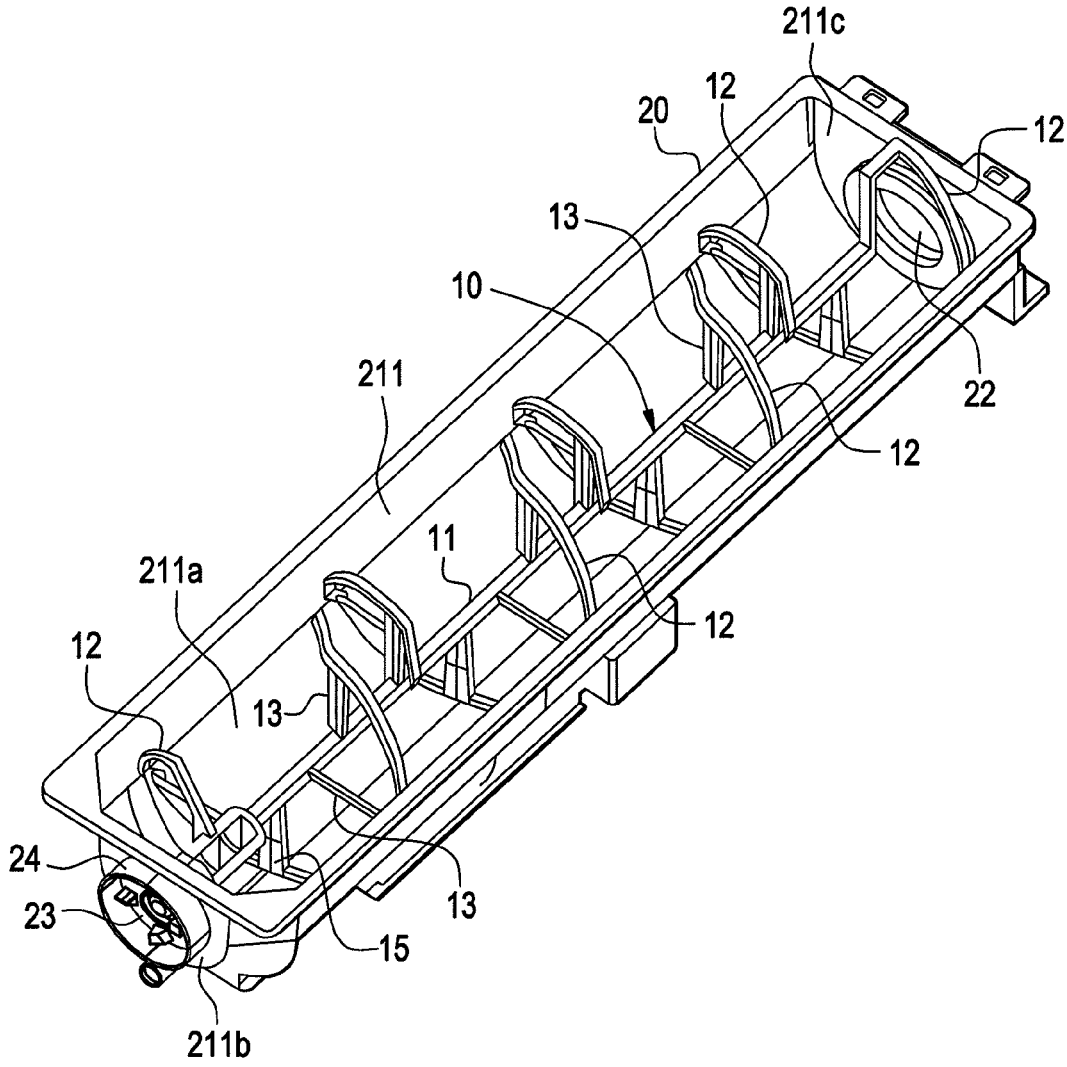
FIG. 3 is an oblique perspective figure of a main part of a rotator for powder conveyance according to a first exemplary embodiment of the present invention that is fixed in a container.
Figure 4:
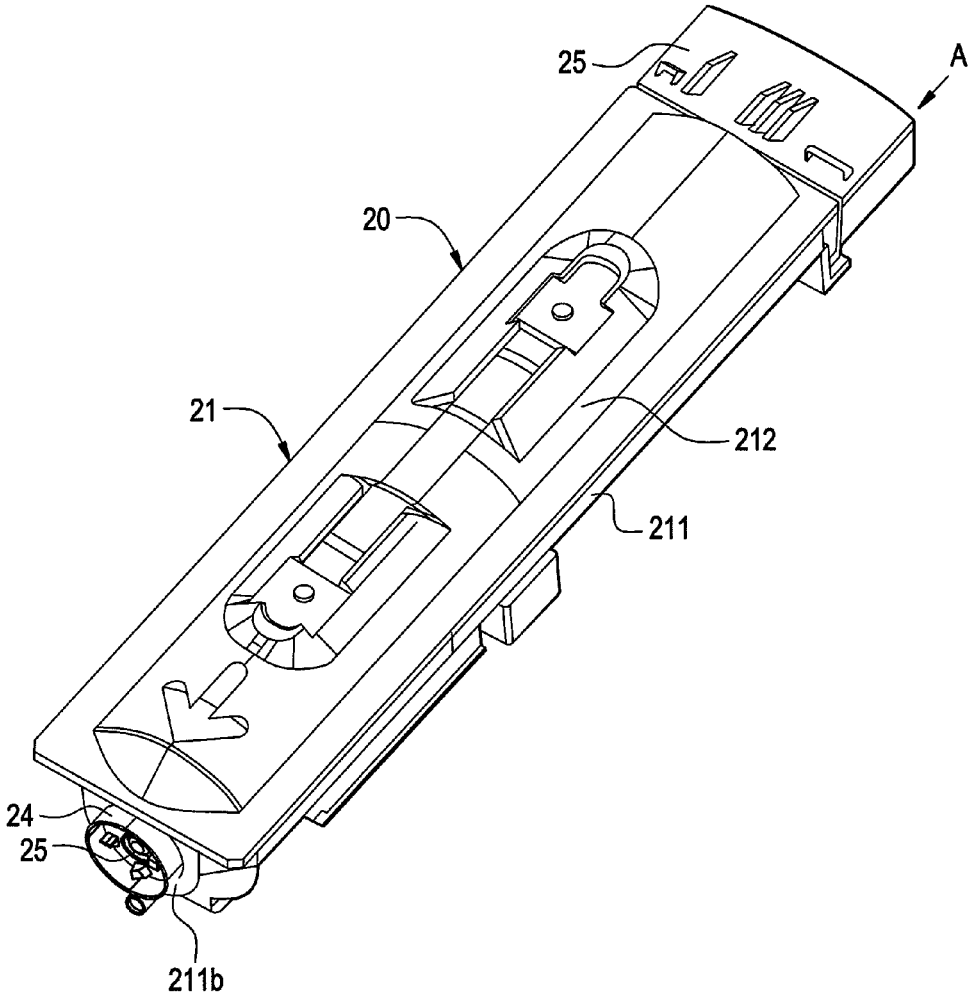
FIG. 4 is an oblique perspective figure of a toner cartridge in which a rotator for powder conveyance according to a first exemplary embodiment of the present invention is built.
Figure 5:
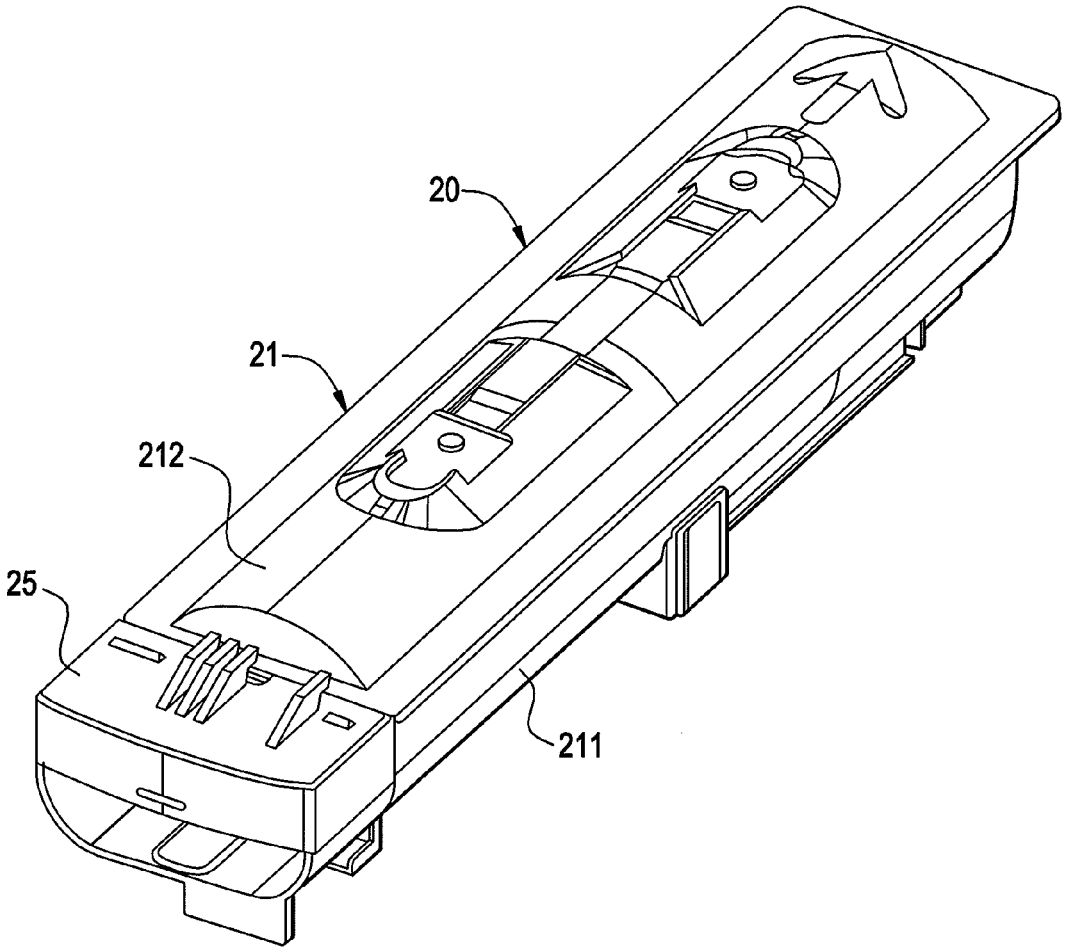
FIG. 5 is an oblique perspective figure of a toner cartridge viewed from side A of FIG. 4.

FIG. 1 is an external view of a rotator for powder conveyance according to the first exemplary embodiment of the present invention. FIG. 2 is a plain view of a rotator for powder conveyance according to the first exemplary embodiment of the present invention. FIG. 3 is an oblique perspective figure of a main part of a rotator for powder conveyance according to the first exemplary embodiment of the present invention that is fixed in a container. FIG. 4 is an oblique perspective figure of a toner cartridge in which a rotator for powder conveyance according to the first exemplary embodiment of the present invention is built. FIG. 5 is an oblique perspective figure of a toner cartridge viewed from side A of FIG. 4.

Rotator for powder conveyance 10 according to the first exemplary embodiment is used for stirring and conveying powder such as toner. Rotator for powder conveyance 10 has, as shown in FIGS. 2 and 3, rotary supporting shaft 11 and plural lot-shaped stirring/conveying pieces 12 that are separated from each other in the longitudinal direction of rotary supporting shaft 11, and arranged at given spaces L1 throughout the length of rotary supporting shaft 11. Rotary supporting shaft 11 has a linear or substantially linear shape. Plural stirring/conveying pieces 12 lie away from the central axis of rotary supporting shaft 11 by given radius R1, and are formed of a material bent in a spiral configuration along the outer peripheral surface of rotary supporting shaft 11. Plural stirring/conveying pieces 12 have a given length. Plural stirring/conveying pieces 12 are respectively connected to rotary supporting shaft 11 via connecting piece 13 in plural points. Spiral-shaped stirring/conveying piece 12 has a length equal to or approximately equal to, for example, the circumference of a circle with radius R1 and with the central axis of rotary supporting shaft 11 at its center.

Stirring/conveying piece 12 has auxiliary stirring/conveying piece 14 provided at one or both ends thereof, which are formed so that they extend in a direction toward an adjacent stirring/conveying piece that is located at given distance L in the longitudinal direction of rotary supporting shaft 11 from stirring/conveying piece 12. Tips 14*a* of adjacent auxiliary stirring/conveying pieces 14 overlap within range d, as shown in FIGS. 2 and 3.

Rotary supporting shaft 11 has U-shaped auxiliary stirring piece 15 provided at one end, as shown in FIGS. 2 and 3. Auxiliary stirring piece 15 extends by a given length in the radial direction of rotary supporting shaft 11. Rotary supporting shaft 11 also has connector 16 for rotation transmission provided at one end, as shown in FIGS. 2 and 3. Connector 16 is connected to a driving unit (not shown) via coupling 23 shown in FIG. 3.

Rotator for powder conveyance 10 is made of a synthetic resin material such as ABS.

Figure 6:
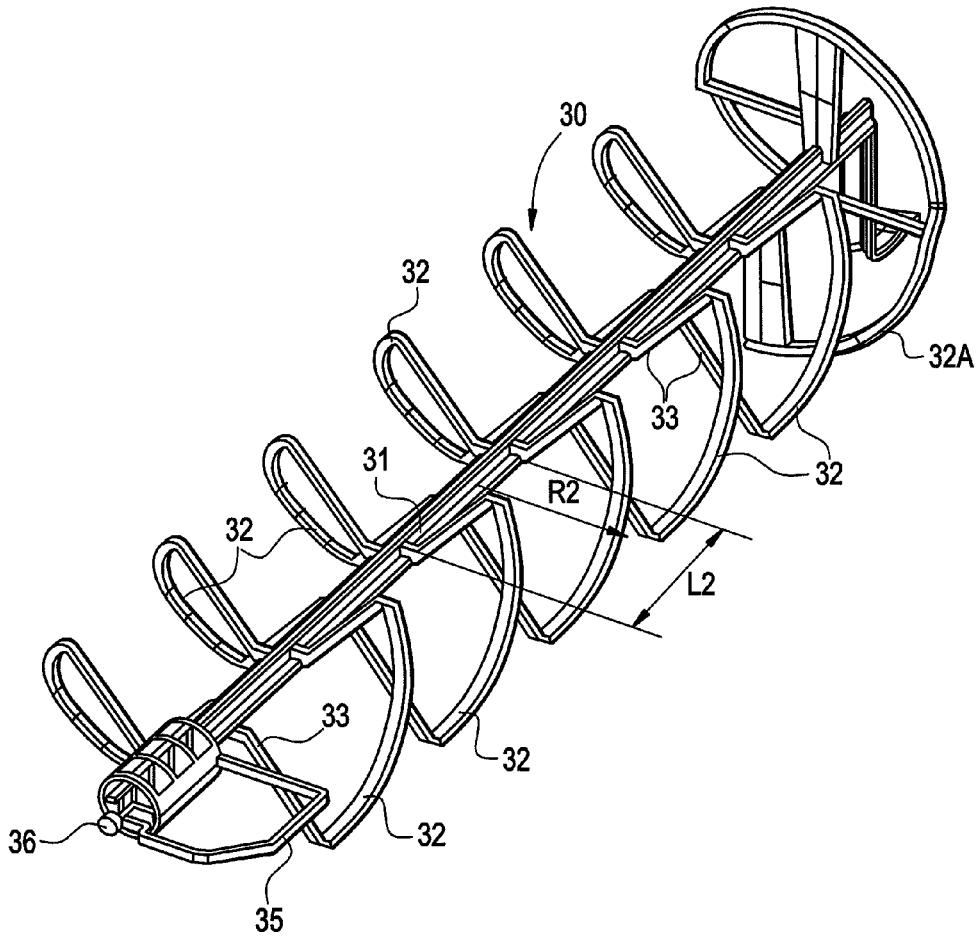
FIG. 6 is an external view of a rotator for powder conveyance according to a second exemplary embodiment of the present invention.

As is shown in FIGS. 4-6, toner cartridge 20 is provided with container 21 that houses toner and is provided with toner supply port 22. In container 21, rotator for powder conveyance 10, which is configured as shown in FIGS. 2 and 3, is provided so as to be rotatable. Rotator for powder conveyance 10 churns and conveys toner housed in container 21 to toner supply port 22.

Container 21 has substantially semicylindrical body 211 that is capable of accommodating rotator for powder conveyance 10 so as to be rotatable, and arc-shaped cover 212 that closes opening 211*a* of body 211. Body 211 has cylindrical supporting part 24 that supports coupling 23 so as to be rotatable at side wall 211*b*, and also has toner supply port 22 at side wall 211*c* opposite to side wall 211*b*. At the side of toner supply port 22 of container 21, toner hopper 25 that receives toner carried out from toner supply port 22 is detachably provided.

The inside diameter of body 211 having a substantially semicylindrical shape is set slightly larger than the outside diameter of stirring/conveying piece 12 constituting rotator for powder conveyance, so that the outer peripheral surface of stirring/conveying piece 12 does not come into contact with the inner peripheral surface of body 211.

In rotator for powder conveyance 10 according to the first exemplary embodiment configured as described above and toner cartridge 20 using the rotator, stirring/conveying pieces 12 which lie away from the central axis of rotary supporting shaft 11 by given radius R1, are formed of a material bent in a spiral configuration along the outer peripheral surface of rotary supporting shaft 11, and have a given length equal to, for example, the circumference of a circle with radius R and with the central axis of rotary supporting shaft 11 at its center. Also, stirring/conveying pieces 12 are arranged at given spaces L1 along the entire length of rotary supporting shaft 11, and are respectively connected to rotary supporting shaft 11 via connecting pieces 13. Accordingly, it is prevented that load resulting from stirring and conveyance is cumulatively applied to each of stirring/conveying pieces 12. Consequently, a change in the outside diameter of each of stirring/conveying pieces 12 is minimized, a clearance between stirring/conveying pieces 12 and the internal surface of container 21 can be set smaller, the amount of powder left behind is reduced, stable conveyance of powder is realized, and damage to the internal surface of container 21 caused by contact with stirring/conveying pieces 12 is prevented.

Also, since stirring/conveying pieces 12 are separated from each other, it is prevented that cumulative load of conveyance concentrates on one of stirring/conveying pieces 12. Consequently, resistance to breakage of stirring/conveying pieces 12 is improved. Also, since rotator for powder conveyance is made of a single material such as ABS, the manufacturing cost is reduced.

Also, in the present exemplary embodiment, stirring/conveying piece 12 has one or two auxiliary stirring/conveying pieces 14 at one or two ends of itself, which are formed so that they extend in a direction toward an adjacent stirring/conveying piece that is located at given distance from stirring/conveying piece 12, and tips 14*a* of adjacent auxiliary stirring/conveying pieces 14 overlap. Accordingly, the amount of powder left between stirring/conveying pieces 12 is reduced.

Also, in the present exemplary embodiment, since rotary supporting shaft 11 has auxiliary stirring piece 15 at one end having connector 16 for rotation transmission, which extends in the radial direction of rotary supporting shaft 11, aggregation and accumulation of powder such as toner in an end having connector 16 for rotation transmission are prevented.

Second Exemplary Embodiment

Figure 7:
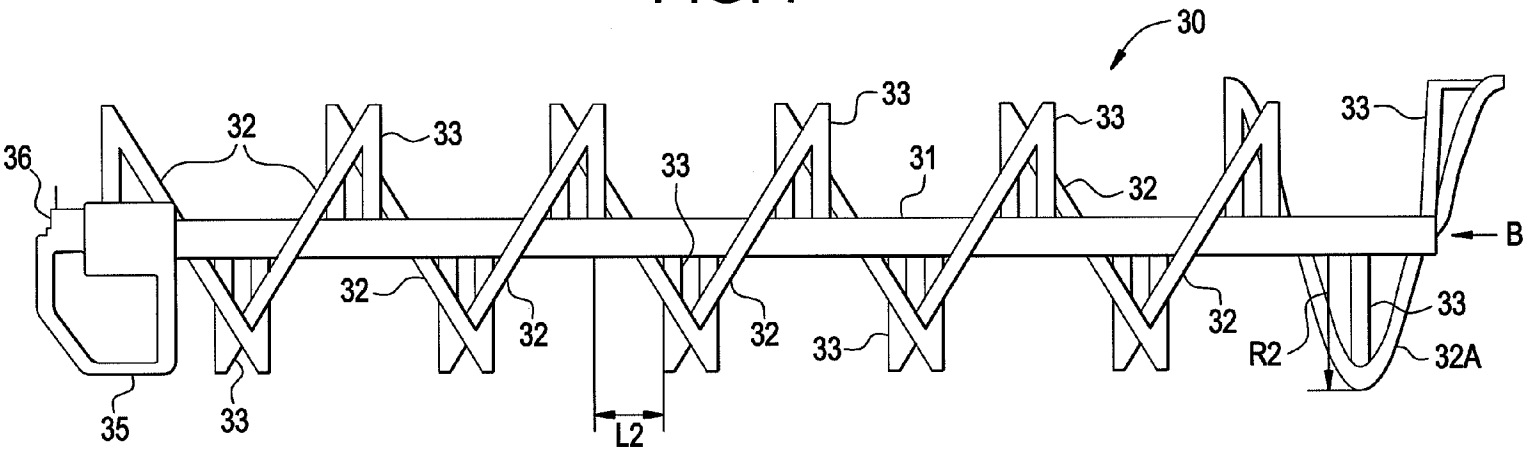
FIG. 7 is a plain view of a rotator for powder conveyance according to a second exemplary embodiment of the present invention.
Figure 8:
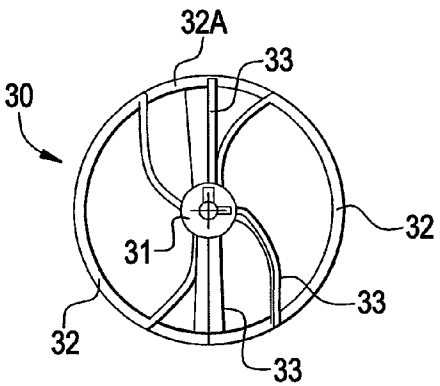
FIG. 8 is a lateral view of a rotator for powder conveyance viewed from side B of FIG. 7.

A second exemplary embodiment of a rotator for powder conveyance according to the present invention will be described with reference to FIGS. 7-9.

FIG. 6 is an external view of a rotator for powder conveyance according to the second exemplary embodiment of the present invention. FIG. 7 is a plain view of a rotator for powder conveyance according to the second exemplary embodiment of the present invention. FIG. 8 is a lateral view of a rotator for powder conveyance viewed from side B of FIG. 7.

Rotator for powder conveyance 30 according to the second exemplary embodiment is used for stirring and conveying powder such as toner. Rotator for powder conveyance 30 has, as shown in FIG. 6, rotary supporting shaft 31 and plural lot-shaped stirring/conveying pieces 32 that are separated from each other in the longitudinal direction of rotary supporting shaft 31, and arranged at given spaces L2 throughout the length of rotary supporting shaft 31. Rotary supporting shaft 31 has a linear or substantially linear shape. Plural stirring/conveying pieces 32 lie away from the central axis of rotary supporting shaft 31 by given radius R2, and are formed of a material bent in a spiral configuration along the outer peripheral surface of rotary supporting shaft 31. Plural stirring/conveying pieces 32 have a given length. Plural stirring/conveying pieces 32 are respectively connected to rotary supporting shaft 31 via connecting piece 33 at plural points.

Among stirring/conveying pieces 32, stirring/conveying pieces 32 other than stirring/conveying piece 32A lying in an end of rotary supporting shaft 31 have a length equal to or approximately equal to, for example, one-third of the circumference of a circle with radius R2 and with the central axis of rotary supporting shaft 31 at its center (a range of approximately 120 degrees). Stirring/conveying piece 32A lying in an end of rotary supporting shaft 31 has a length equal to, for example, the circumference of a circle with radius R2 and with the central axis of rotary supporting shaft 31 at its center.

Rotary supporting shaft 31 has U-shaped auxiliary stirring piece 35 at one end as shown in FIG. 6. Auxiliary stirring piece 35 extends by a given length in the radial direction of rotary supporting shaft 31. Rotary supporting shaft 31 also has connector 36 for rotation transmission at one end as shown in FIG. 6. Connector 36 is connected to a driving unit (not shown) via coupling 23 shown in FIG. 3.

Rotator for powder conveyance 30 is made of a synthetic resin material such as ABS.

In rotator for powder conveyance 30 according to the second exemplary embodiment configured as described above, stirring/conveying pieces 32 lie away from the central axis of rotary supporting shaft 31 by given radius R2, are formed of a material bent in a spiral configuration along the outer peripheral surface of rotary supporting shaft 31, and have a given length equal to, for example, one-third of the circumference of a circle with radius R2 and with the central axis of rotary supporting shaft 31 at its center. Also, stirring/conveying pieces 32 are arranged at given spaces L2 along the entire length of rotary supporting shaft 31, and are respectively connected to rotary supporting shaft 31 via connecting piece 33. Accordingly, load resulting from stirring and conveyance is prevented from being cumulatively applied to each of stirring/conveying pieces 32. Consequently, a change in the outside diameter of each of stirring/conveying pieces 32 is minimized, a clearance between stirring/conveying pieces 32 and the internal surface of a container can be set smaller, the amount of powder left behind is reduced, stable conveyance of powder is realized, and damage to the internal surface of a container caused by contact with stirring/conveying pieces 32 is prevented.

Also, since stirring/conveying pieces 32 are separated from each other, it is prevented that cumulative load of conveyance concentrates on one of stirring/conveying pieces 32. Consequently, resistance to breakage of stirring/conveying pieces 32 is improved. Also, since rotator for powder conveyance is made of a single material such as ABS, the manufacturing cost is reduced.

Also, since the length of stirring/conveying piece 32A lying adjacent to a toner supply port of a container is equal to a length of the circumference of a circle with radius R2 and with the central axis of rotary supporting shaft 31 at its center, toner housed in a container is effectively conveyed to a toner supply port.

Also, in the present exemplary embodiment, since rotary supporting shaft 31 has auxiliary stirring piece 35 at one end having connector 36 for rotation transmission, which extends in the radial direction of rotary supporting shaft 31, aggregation and accumulation of powder such as toner in an end having connector 36 for rotation transmission are prevented.

It should be noted that the shape and the length of stirring/conveying pieces of a rotator for powder conveyance according to the present invention is not limited to the shape described in the above exemplary embodiments. The length of stirring/conveying pieces is not limited to a length of the circumference of a circle with a given radius and with the central axis of a rotary supporting shaft at its center, or to a length of one-third of the circumference of the circle. The shape and the length of stirring/conveying pieces can be variously changed without departing from the scope of the claims.

Also, it should be noted that stirring/conveying pieces of a rotator for powder conveyance according to the present invention do not need to be arranged at given spaces L1 or L2 throughout the length of a rotary supporting shaft. The spaces may be randomly set.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principle of the invention and its practical application, thereby enabling others skilled in the art to understand the invention for various embodiments and with the various modifications as are suited to the particular use contemplated. It is intended that the scope of the invention be defined by the following claims and their equivalents.

What is claimed is:

1. A rotator for powder conveyance comprising:
a substantially linear rotary supporting shaft; and
a plurality of stirring/conveying pieces that
are separated from each other by a distance and arranged in a longitudinal direction along the rotary supporting shaft;
wherein each of the stirring/conveying pieces are placed at positions separated from a central axis of the rotary supporting shaft in a radial direction of the rotary supporting shaft and
have a spiral configuration along an outer peripheral surface of the rotary supporting shaft;
wherein each of the stirring/conveying pieces are respectively connected to the rotary supporting shaft via a connecting piece,
wherein the stirring/conveying pieces are provided at a substantially same distance from the rotary supporting shaft, and
wherein the plurality of stirring/conveying pieces have the same handedness.

2. The rotator for powder conveyance according to claim 1, wherein a length of the spiral-shaped stirring/conveying pieces is substantially within a range of from a length of a circumference of the rotary supporting shaft and a length of approximately one-third of the circumference of the rotary supporting shaft.

3. The rotator for powder conveyance according to claim 1, wherein at least one of stirring/conveying pieces has an auxiliary stirring/conveying piece at one or both ends of the one stirring/conveying piece, the auxiliary stirring/conveying pieces being formed so that the auxiliary stirring/conveying pieces extend in a direction toward an adjacent stirring/conveying piece that is located at a given distance from the one stirring/conveying piece.

4. The rotator for powder conveyance according to claim 1, further comprising an auxiliary stirring piece positioned at an end of the rotary supporting shaft where a connector for rotation transmission is provided, and extending in a radial direction of the rotary supporting shaft.

5. A toner cartridge comprising:
a container that houses toner and has a toner supply port in a side wall of the container;
a rotator for powder conveyance that is provided in the container so as to be rotatable, and that stirs and conveys toner housed in the container to the toner supply port, comprising:
a substantially linear rotary supporting shaft; and
a plurality of stirring/conveying pieces that
are separated from each other and arranged in a longitudinal direction along the rotary supporting shaft;
wherein each of the stirring/conveying pieces are placed at positions separated from a central axis of the rotary supporting shaft in a radial direction of the rotary supporting shaft and have a spiral configuration along an outer peripheral surface of the rotary supporting shaft; and
wherein each of the stirring/conveying pieces are respectively connected to the rotary supporting shaft via a connecting piece.

6. The toner cartridge according to claim 5, wherein a length of the spiral-shaped stirring/conveying pieces is substantially within a range of from a length of a circumference of the rotary supporting shaft and a length of approximately one-third of the circumference of the rotary supporting shaft.

7. The toner cartridge according to claim 5, wherein at least one of the stirring/conveying pieces has an auxiliary stirring/conveying pieces at one or both ends of the one stirring/conveying piece, the auxiliary stirring/conveying pieces being formed so that the auxiliary stirring/conveying pieces extend in a direction toward an adjacent stirring/conveying piece that is located at given distance from the at least one stirring/conveying piece.

8. The toner cartridge according to claim 5, further comprising a toner hopper provided at one end of the container, that receives toner carried out from the toner supply port.

9. The toner cartridge according to claim 5, further comprising an auxiliary stirring piece positioned at one end of the rotary supporting shaft where a connector for rotation transmission is provided, and extending in a radial direction of the rotary supporting shaft.

10. A rotator for powder conveyance comprising:
a substantially linear rotary supporting means; and
a plurality of stirring/conveying means that
are separated from each other by a distance and arranged in a longitudinal direction along the rotary supporting means;

wherein each of the stirring/conveying means are placed at positions separated from a central axis of the rotary supporting means in a radial direction of the rotary supporting means and have a spiral configuration along an outer peripheral surface of the rotary supporting means;

wherein each of the stirring/conveying means are respectively connected to the rotary supporting means via a connecting means, wherein the stirring/conveying means are provided at a substantially same distance from the rotary supporting means, and wherein the plurality of stirring/conveying means have the same handedness.

11. The rotator for powder conveyance according to claim 1, wherein each of the stirring/conveying pieces are respectively connected to the rotary supporting shaft at a plurality of points.

12. The toner cartridge according to claim 5, wherein each of the stirring/conveying pieces are respectively connected to the rotary supporting shaft at a plurality of points.

13. The rotator for powder conveyance according to claim 10, wherein each of the stirring/conveying means are respectively connected to the rotary supporting means at a plurality of points.

14. The rotator for powder conveyance according to claim 1, wherein one end of each of the stirring/conveying pieces is connected to the rotary supporting shaft via the connecting piece, and wherein another end of each of the stirring/conveying pieces is connected to the rotary supporting shaft via another connecting piece.

15. The toner cartridge according to claim 5, wherein one end of each of the stirring/conveying pieces is connected to the rotary supporting shaft via the connecting piece, and wherein another end of each of the stirring/conveying pieces is connected to the rotary supporting shaft via another connecting piece.

16. The rotator for powder conveyance according to claim 10, wherein one end of each of the stirring/conveying means is connected to the rotary supporting means via the connecting means, and wherein another end of each of the stirring/conveying means is connected to the rotary supporting means via another connecting means.

17. The rotator for powder conveyance according to claim 1, wherein the rotator does not have another stirring/conveying piece that has a different handedness than the plurality of stirring/conveying pieces.

18. The toner cartridge according to claim 5, wherein the plurality of stirring/conveying pieces have the same handedness, and wherein the rotator does not have another stirring/conveying piece that has a different handedness than the plurality of stirring/conveying pieces.

19. The rotator for powder conveyance according to claim 10, wherein the rotator does not have another stirring/conveying means that has a different handedness than the plurality of stirring/conveying means.

20. The toner cartridge according to claim 18, wherein the stirring/conveying pieces are provided at a substantially same distance from the rotary supporting shaft, and wherein adjacent stirring/conveying pieces are not connected to the rotary supporting shaft by a common connecting piece.

21. The toner cartridge according to claim 1, wherein adjacent stirring/conveying pieces are not connected to the rotary supporting shaft by a common connecting piece.

22. The toner cartridge according to claim 10, wherein adjacent stirring/conveying means are not connected to the rotary supporting means by a common connecting means.

* * * * *